United States Patent [19]

Wada

[11] Patent Number: 4,570,681

[45] Date of Patent: Feb. 18, 1986

[54] APPARATUS FOR STOPPING WEAVING MACHINE AT PREDETERMINED POSITION

[75] Inventor: Yoshimi Wada, Higashiyamato, Japan

[73] Assignee: Nissan Motor Co., Ltd., Yokohama City, Japan

[21] Appl. No.: 540,665

[22] Filed: Oct. 11, 1983

[30] Foreign Application Priority Data

Oct. 12, 1982 [JP] Japan ..... 57-177534

[51] Int. Cl.[4] ..... D03D 51/02

[52] U.S. Cl. ..... 139/1 E; 139/336

[58] Field of Search ..... 139/1 E, 336 R, 370.2; 318/467, 480; 364/469, 470

[56] References Cited

U.S. PATENT DOCUMENTS 3,805,849 4/1974 Steverlynck ..... 139/1 E
3,805,850 4/1974 Dunyhoven et al. ..... 139/435
4,364,002 12/1982 Suzuki et al. ..... 139/1 E

FOREIGN PATENT DOCUMENTS 7908941 6/1980 Netherlands ..... 139/1 E

*Primary Examiner*—Henry S. Jaudon
*Attorney, Agent, or Firm*—Jeffery, Schwaab, Mack, Blumenthal & Evans Schwartz

[57] ABSTRACT

A weaving machine is combined with a stop control means. A warp feeler, a weft feeler or a manual stop switch produces a stop signal and sends it to the control means. A comparator compares a crank angle sensed by a crank angle sensor with a preset angle supplied by a preset angle supplier, and produces a position signal at the preset angle. If the control means receives the stop signal during a normal weaving operation, then the control means stops the weaving machines immediately regardless of the crank angle by sending an output signal to a brake system of the weaving machine. After that, the control means starts the weaving machine moving at a slow speed, and stops this slow speed movement when the comparator produces the position signal at the preset angle.

8 Claims, 5 Drawing Figures

APPARATUS FOR STOPPING WEAVING MACHINE AT PREDETERMINED POSITION

BACKGROUND OF THE INVENTION

The present invention relates to apparatus and method for stopping a weaving machine at a predetermined crank angle.

A crank angle is a rotation angle of a main shaft of a weaving machine, provided the crank angle is zero degree when the machine is at a position of beating each pick of weft.

In many cases, a weaving machine is arranged to stop at a predetermined position when a stop signal is produced for some reason. For example, a weaving machine is stopped at a position where the shed is closed if warp breakage is detected, and at a position where the shed is open if a mispick is detected.

In an ordinary weaving machine, warp breakage and mispick are detected, and stop signals are produced at respective certain crank angles. Therefore, it is possible to stop a weaving machine at a predetermined crank angle by transmitting the stop signal produced at a specified crank angle, through a delay circuit with a delay of a predetermined time interval.

However, this stopping method cannot stop a weaving machine precisely at a desired position, because a rotation angle required to bring the moving machine to a stop from a given speed varies considerably depending on the speed of the weaving machine and the condition of a brake system, even if the time interval of the delay is constant. This undesired tendency is increased as the speed of the weaving operation is increased.

SUMMARY OF THE INVENTION

It is an object of the present invention to provide a weaving machine which can be stopped precisely at a predetermined crank angle and a method for stopping a weaving machine precisely at a predetermined crank angle.

According to the present invention, a weaving system comprises a weaving mechanism, actuating means for changing the operating state of the weaving mechanism, stop signal producing means, angle sensing means for sensing an angular position of a main shaft of said weaving mechanism with respect to a reference angular position, preset angle supplying means, comparing means for comparing the angle sensed by the angle sensing means with the preset angle of the preset angle supplying means, and control means. The weaving mechanism comprises a main mechanism including the main shaft, main driving means for providing a normal operation mode by driving the main mechanism at a normal speed, secondary driving means for providing a first slow operation mode by driving the main mechanism at a slow speed, and braking means for stopping the movement of the main mechanism. The control means is connected with the stop signal producing means and the comparing means so as to receive the stop signal and a position signal which is produced by the comparing means when the sensed angle becomes equal to the preset angle. The control means is further connected with the actuating means for changing the operating mode of the weaving mechanism by commanding the actuating means. If the control means receives the stop signal from the stop signal producing means during the operation of the normal operation mode, the control means immediately stops the normal speed movement of the main mechanism regardless of the crank angle by actuating the braking means. After that, the control means starts the operation of the first slow operation mode and stops this operation when the comparing means produces the position signal at the preset angle.

DETAILED DESCRIPTION OF THE INVENTION

Figure 1:
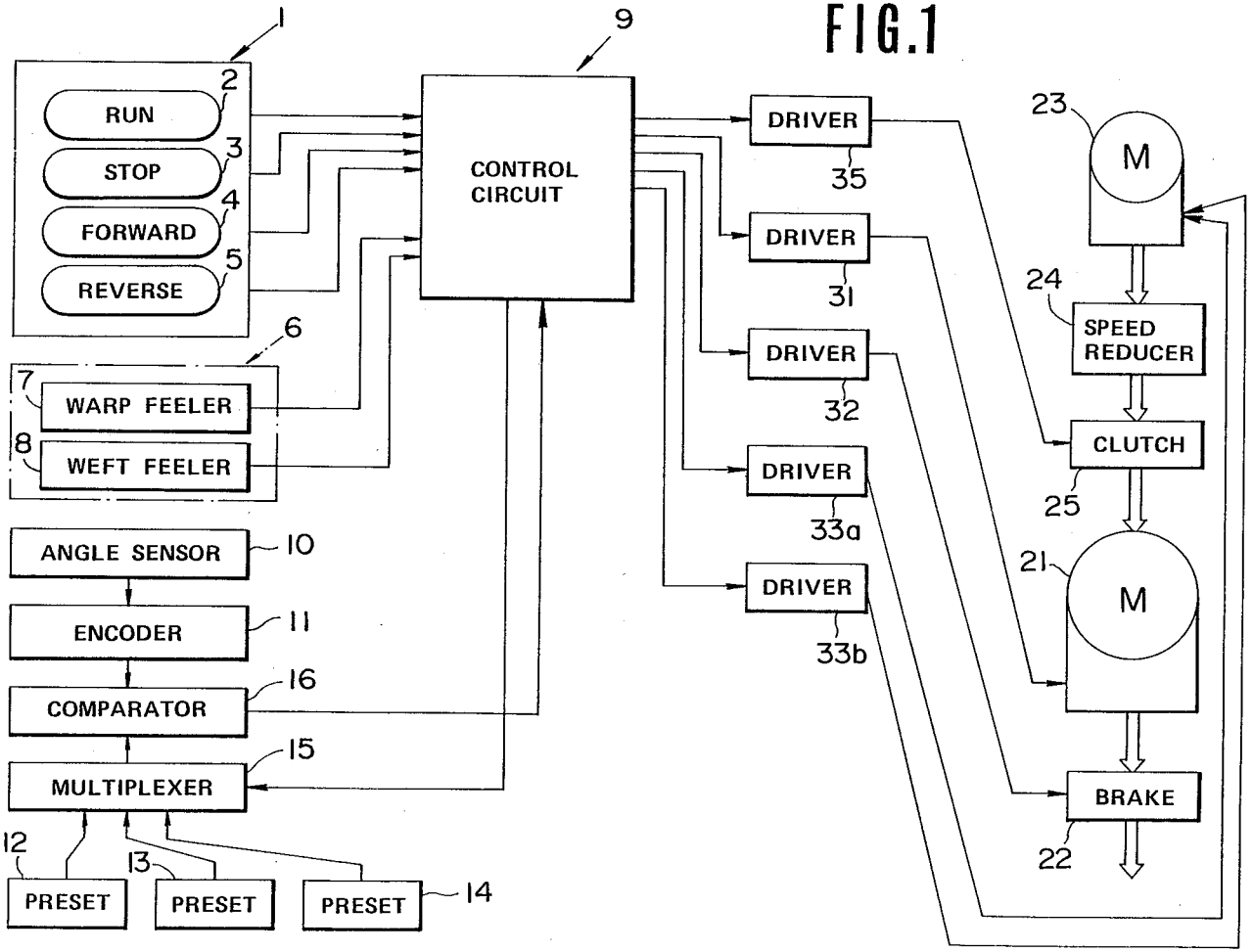
FIG. 1 is a block diagram of a weaving system embodying the present invention.

In FIG. 1, a main motor 21 for a normal operation of a weaving machine is connected to a main shaft (not shown) of the weaving machine. A brake 22 is provided on the output side of the main motor 21. A motor 23 of a relatively small size for inching is connected to the other side of the main motor 21 through a speed reducer 24 and a clutch 25.

The main motor 21, brake 22, inching motor 23 and clutch 25 are controlled by a control circuit 9 through driver circuits 31, 32, 33*a*, 33*b* and 35, respectively.

An operational panel 1 of the weaving machine has a run switch 2 for starting the normal operation of the weaving machine, a stop switch 3, a forward inching switch 4, and a reverse inching switch 5. The loom is equipped with an abnormality detector 6 which includes a warp feeler 7 for detecting warp breakage, and a weft feeler or filling feeler 8 for detecting mispick. The switches 2–5 and the feelers 7 and 8 are connected to the control circuit 9 individually so that each output is inputted to the control circuit 9.

There is further provided a crank angle sensor 10 for sensing the crank angle of the loom. The crank angle sensor 10 is connected to an encoder 11 so that the encoder 11 receives the output of the crank angle sensor 10. The crank angle sensor 10 and encoder 11 constitute a means which is often referred to as a rotary encoder.

There are further provided three preset angle selectors 12, 13 and 14 each for supplying a preset crank angle at which the loom is to be stopped. The first selector 12 is set at a crank angle of 300 degrees at which the shed is closed. The second selector 13 is set at 180 degrees at which the shed is open. The third selector 14 is capable of being set at any crank angle. The selectors 12, 13 and 14 are connected to a multiplexor 15, individually. Each of the selectors 12, 13 and 14 sends an output indicative of its preset angle to the multiplexer 15. In response to a signal sent from the control circuit 9, the multiplexer 15 chooses one among the three outputs of the selectors 12, 13 and 14 in an alternative way. When the warp feeler 7 detects a broken warp and comes to be in the on state, the multiplexer 15 chooses and delivers the output of the first selector 12 under the command of the control circuit 9. When the weft feeler 8 changes to the on state because of the detection of a broken weft, or when the stop switch 3 is turned on, the control circuit 9 commands the multiplexer 15 to choose the output of the second selector 13. When the forward or reverse inching switch 4 or 5 is switched on, the control circuit 9 causes the multiplexer 15 to choose the output of the third selector 14.

A comparator 16 is connected with the encoder 11 and the multiplexer 15. The comparator 16 receives the output signals of the encoder 11 and the multiplexer 15, and sends a comparator signal (a position signal) to the control circuit 9 when the output signal of the encoder 11 agrees with the output of the multiplexer 15.

Figure 2:
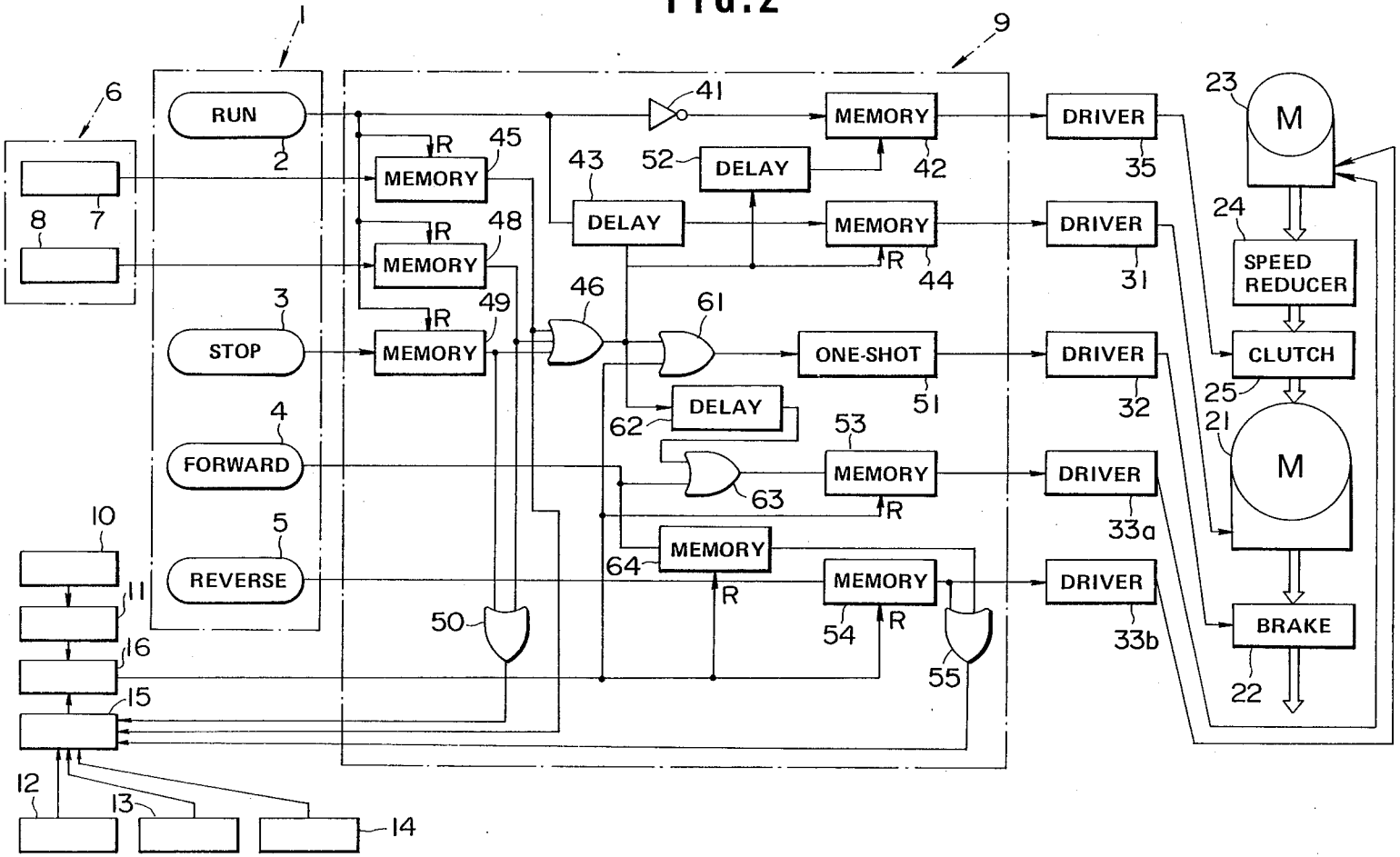
FIG. 2 is a block diagram showing one example of a control circuit shown in FIG. 1.
Figure 3:
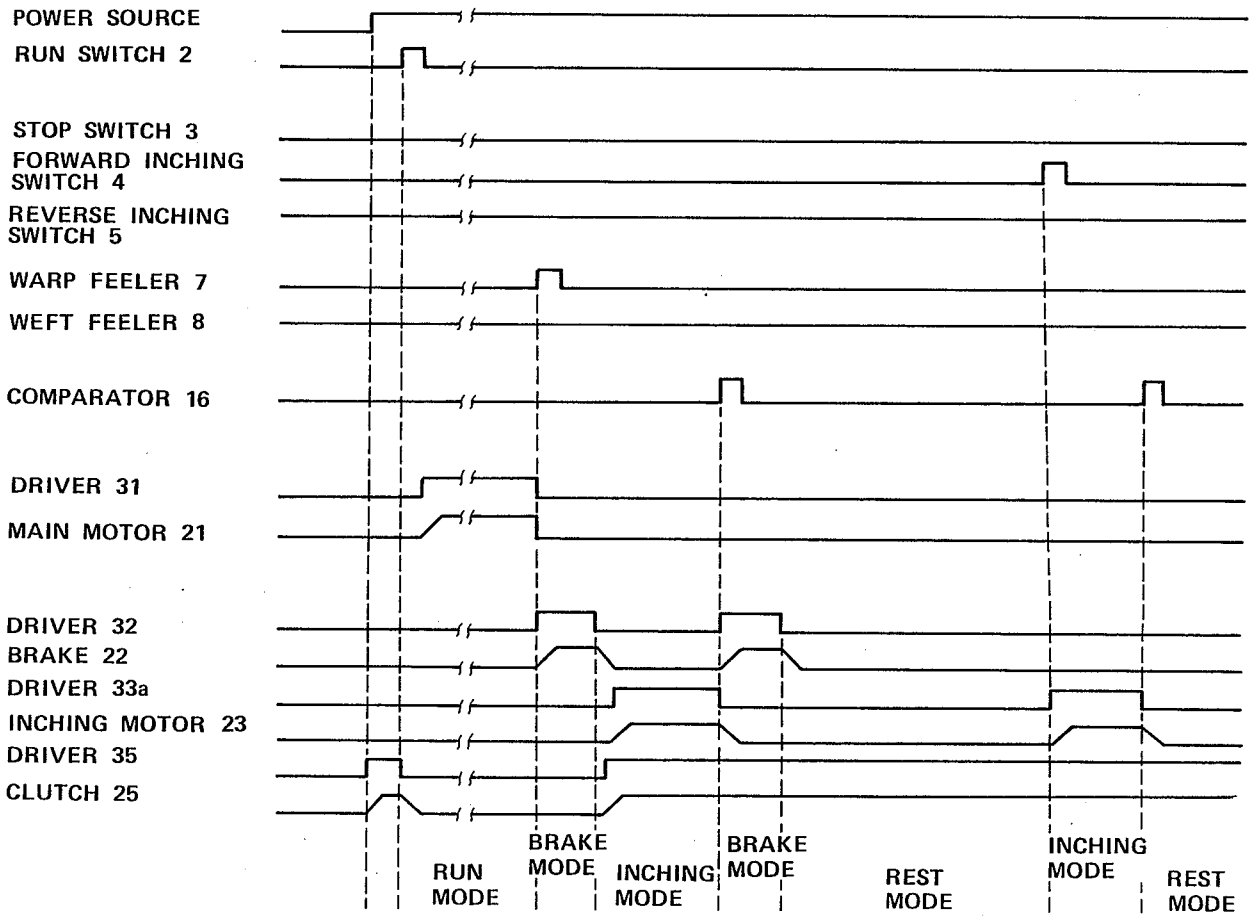
FIG. 3 is a timing chart showing the operations of the system of FIG. 1.

FIG. 2 shows one example of the control circuit 9 in detail, and FIG. 3 shows the operations of the weaving machine. In a state in which the power source is connected to the weaving machine but the run switch 2 is not turned on, a NOT circuit 41 produces a "one" signal, which is outputted through a memory circuit 42 to the clutch driver circuit 35. In response to this output signal of the control circuit 9, the clutch driver circuit 35 actuates the clutch 25, so that the main motor 21 is connected with the speed reducer 25.

When the run switch 2 is turned on, memory circuits 45, 48 and 49 are reset. At the same time the output of the NOT circuit 41 is changed to an opposite state, so that the clutch 25 is disengaged, and the main motor 21 is disconnected from the speed reducer 24. A "one" signal sent from the run switch 2 is delayed by a delay circuit 43, and then outputted through a memory circuit 44 to the driver 31. In response to this, the driver 31 actuates the main motor 21 to start the normal operation of the weaving machine.

If the warp feeler 7 produces a stop signal during the weaving operation, a "one" signal of the memory circuit 45 is sent to an OR circuit 46, and a first terminal of the multiplexer 15. In response to this signal, the multiplexer 15 chooses the first selector 12 whose preset angle is 300°. If the weft feeler 8 produces a stop signal, or if the stop switch 3 is turned on, a "one" signal of the memory circuit 48 or the memory circuit 49 is fed to the OR circuit 46. At the same time, this signal is sent, through an OR circuit 50, to a second terminal of the multiplexer 15, so that the multiplexer 15 chooses the second selector 13 whose preset angle is 180°.

If the OR circuit 46 receives any one of the "one" signals of the memory circuits 45, 48 and 49, as mentioned above, then the OR circuit 46 sends a "one" signal to a reset terminal of the memory circuit 44. Therefore, the memory circuit 44 is reset, and the driver circuit 31 deenergizes the main motor 21. The "one" output of the OR circuit 46 is also sent to an OR circuit 61, so that the OR circuit 61 produces a "one" output. The control circuit 9 outputs the "one" signal of the OR circuit 61 through a one-shot multivibrator 51 to the driver 32, and by so doing actuates the brake 22. Upon receipt of the stop signal, the control circuit 9 thus stops the weaving machine immediately regardless of the crank angle.

The "one" output of the OR circuit 46 is delayed by a delay circuit 52, and then sent to the memory circuit 42 to reset the memory circuit 42, so that the clutch 25 is engaged again. The "one" output of the OR circuit 46 is delayed by a delay circuit 62, and then applied to an OR circuit 63 so that the output of the OR circuit 63 becomes "one". The "one" output of the OR circuit 63 is outputted, through a memory circuit 53, to the driver circuit 33*a*. In response to this signal, the driver circuit 33*a* actuates the inching motor 23. Thus, the inching motor 23 rotates in a forward direction. The rotation of the inching motor 23 is transmitted through the speed reducer 24 and the clutch 25 to the main motor 21, so that the weaving machine is operated at a very slow speed. Thus, the control circuit 9 starts the weaving machine at the very slow speed just after the weaving machine is stopped in response to the stop signal.

During the slow speed movement of the weaving machine, the comparator 16 produces its signal before one revolution is completed. The crank angle sensor 10 always senses the crank angle of the weaving machine. The output signal of the crank angle sensor 10 is encoded by the encoder 11. The comparator 16 compares the crank angle sensed by the crank angle sensor 10 with the preset angle chosen by the multiplexer 15. As mentioned before, the multiplexer 15 chooses, under the command of the control circuit 9, the preset angle (300°) of the first selector 12 in the case of the stop signal of the warp feeler 7, and the preset angle (180°) of the second selector 13 in the case of the stop signals of the weft feeler 8 and the stop switch 3. The comparator 16 produces the comparator signal when the sensed crank angle becomes equal to the thus-chosen preset angle.

The thus-produced comparator output signal in "one" state is applied to the OR circuit 61, and sent to the memory circuit 53 to reset the same. Consequently, the output of the OR circuit 61 becomes "one", and this output is sent through the one-shot multivibrator 51 to the driver 32, which, accordingly, actuates the brake 22. At the same time, the inching motor 23 is disconnected from the power source because the memory circuit 53 is reset by the comparator signal.

In this way, the control circuit 9 stops the weaving machine precisely at 300° in the case of warp breakage, and at 180° in the case of mispick and manual stop. After stoppage, the clutch 25 remains engaged, so that the weaving machine is held at reset by the load of the speed reducer 24.

The weaving machine is brought to a stop from the very slow speed, so that the lag between the output of the comparator signal and the stoppage of the weaving machine is almost negligible. Therefore, the weaving machine can be stopped very accurately at the predetermined position.

If inching operation is desired, first the third selector 14 is set at a desired angle, and then the forward inching switch 4 or the reverse inching switch 5 is turned on. When the forward inching switch 4 is switched on while the weaving machine is at rest, a "one" signal of the forward inching switch 4 is applied to the OR circuit 63. Thus, the OR circuit 63 delivers the "one" signal, which is outputted through the memory circuit 53 to the forward inching driver 33*a*. The forward inching driver 33*a* actuates the inching motor 23 in the forward direction. When the reverse inching switch 5 is switched on, a "one" signal of the reverse inching switch 5 is outputted through a memory circuit 54 to the reverse inching driver 33*b*. Thus, the reverse inching driver 33*b* starts the inching motor 23 in the reverse direction. The forward or reverse rotation of the inching motor 23 is transmitted through the speed reducer 24 and the clutch 25 to the main motor 21 so that the weaving machine is moved at the very slow speed in the forward or reverse direction.

At the same time, an OR circuit 55 receives the "one" signal of the forward inching switch 4 through a memory circuit 64, or the "one" signal of the reverse inching switch 5 through a memory circuit 54. In either case, the OR circuit 55 delivers a "one" signal to a third terminal of the multiplexer 15, so that the multiplexor 15 chooses the third selector 14.

During the inching operation, the comparator 16 compares the angle sensed by the crank angle sensor 10 with the preset angle of the third selector 14, and produces the comparator signal in the "one" state when the sensed angle becomes equal to the preset angle.

The "one" comparator signal is sent to the OR circuit 61, and resets the memory circuit 53 and the memory circuits 54 and 64. Consequently, the OR circuit 61 sends the "one" signal through the one-shot multivibrator 51 to the brake driver 32, which in turn actuates the brake 22. At the same time, the supply of power to the inching motor 23 is stopped because the memory circuit 53 is reset. Thus, the weaving machine is stopped at the angular position preset by the third selector 14.

The control circuit of FIG. 1 can be made of a microcomputer. In this case, the microcomputer is programmed according to the flowchart shown in FIGS. 4 and 5.

Figure 4:
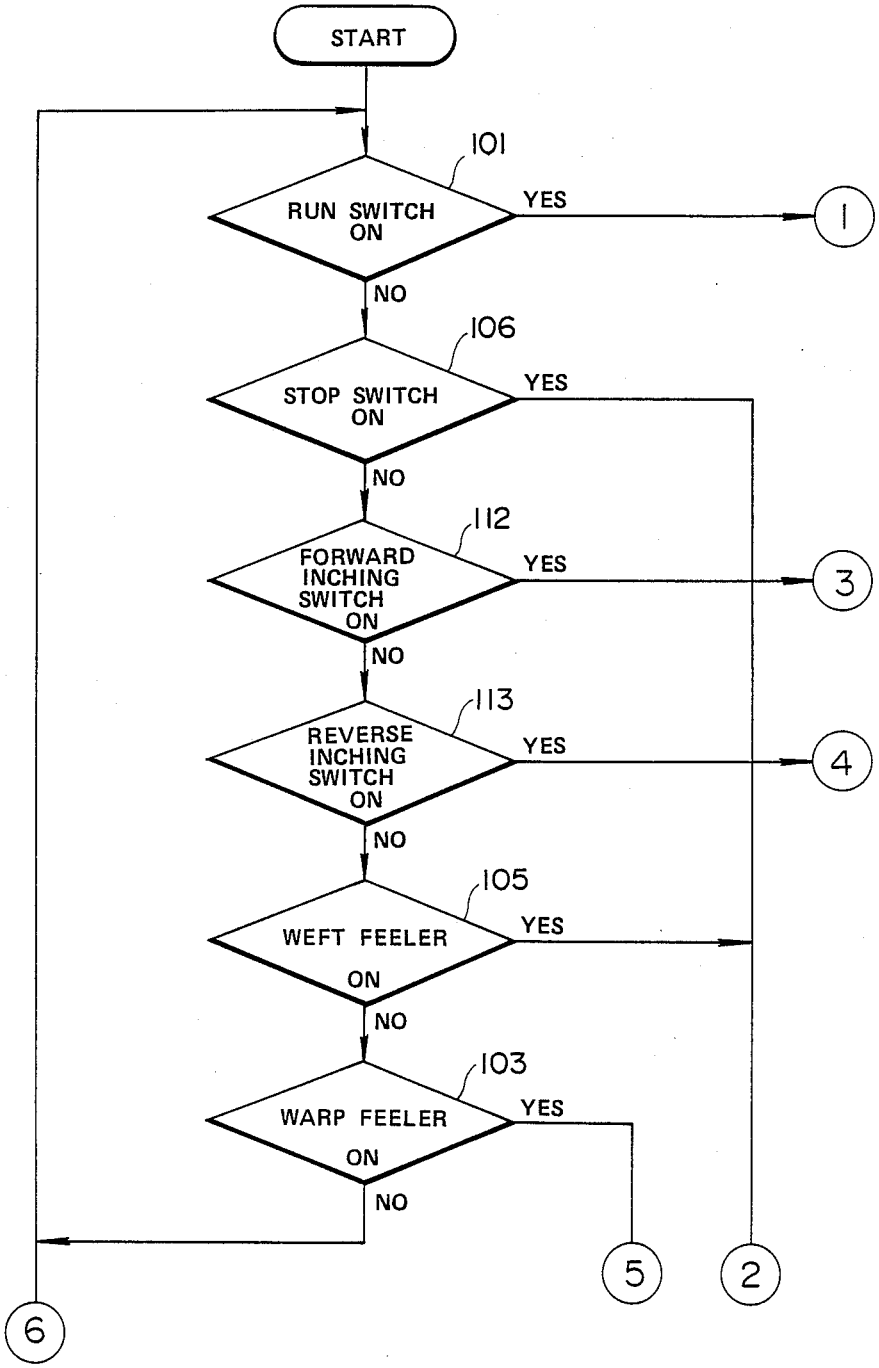
FIGS. 4 and 5 shows a flowchart which is used when the control circuit of FIG. 1 is a microcomputer.
Figure 5:
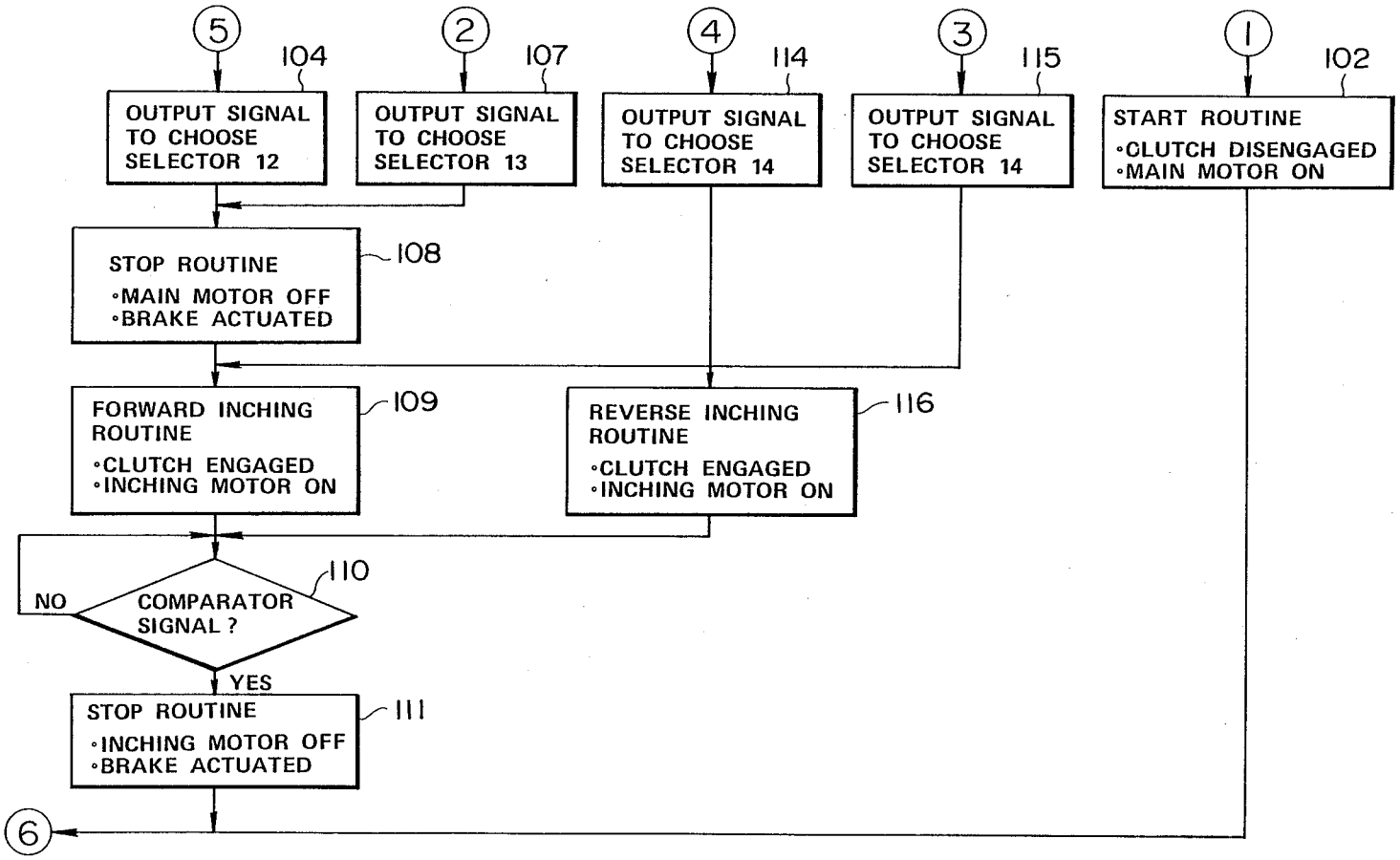

In FIG. 4, there are six decision steps 101, 106, 112, 113, 105 and 103. At the step 101, a check is made to decide whether the run switch 2 is in its on state. If so, the microcomputer 9 enters a start routine 102, in which the microcomputer 9 disengages the clutch 25 and turns on the main motor 21 by delivering its output signals.

If the warp feeler 7 enters the on state during the weaving operation, the microcomputer 9 goes from the step 103 to a step 104, at which the microcomputer 9 chooses the first selector 12 by sending the output signal to the multiplexer 15. If the weft feeler 8 is in the on state, the microcomputer goes from the step 105 to a step 107. If the stop switch 3 is turned on, the microcomputer 9 goes from the step 106 to the same step 107. At the step 107, the microcomputer 9 chooses the second selector 13 by sending the output signal to the multiplexer 15. After the step 104 or the step 107, the microcomputer 9 enters a stop routine 108, in which the microcomputer turns off the main motor 21 and applies the brake 22. After the stop routine 108, the microcomputer 9 executes a forward inching routine 109, in which the microcomputer engages the clutch 25 and turns on the inching motor 23. If it is decided at a next step 110 that the comparator signal is inputted from the comparator 16, then the microcomputer turns off the inching motor 23 and applies the brake 22 in a stop routine 111.

If the forward inching switch 4 or the reverse inching switch 5 is turned on, the step 112 or the step 113 causes the microcomputer 9 to go to a step 115 or a step 114. In either of the steps 114 and 115, the microcomputer choose the third selector 14 by sending the signal to the multiplexer 15. The forward inching routine 109 follows the step 115. The step 114 is followed by a reverse inching routine 116 for inching the weaving machine in the reverse direction. In either case, the forward or the reverse inching operation is continued until an affirmative answer is obtained in step 110, and the stop routine 111 is started.

What is claimed is:

1. A weaving system comprising:

(A) a weaving mechanism which comprises (a) a main mechanism having a main shaft, said main mechanism being arranged to move cyclicly in synchronism with the rotation of said main shaft, (b) main driving means capable of being connected with said main mechanism for driving said main mechanism at a normal speed, (c) secondary driving means capable of being connected with said main mechanism for driving said main mechanism at a slow speed slower than said normal speed, (d) braking means capable of stopping the movement of said main mechanism, said weaving mechanism being capable of being in a normal operation mode in which said main driving means is connected with said main mechanism and actuated to drive said main mechanism at said normal speed, a first slow operating mode in which said secondary driving means is connected with said main mechanism and actuated to drive said main mechanism at said slow speed, and a braking mode in which said braking means is actuated to stop the movement of said main mechanism, (B) actuating means, connected with said main driving means, said secondary driving means and said braking means, for changing the operating mode of said weaving mechanism, (C) means for producing a stop signal, (D) angle sensing means for sending an angular position of said main shaft with respect to a reference angular position, (E) means for supplying a preset angle, (F) means, connected with said angle sensing means and said preset angle supplying means, for comparing the angle sensed by said angle sensing means with the preset angle of said preset angle supplying means, said comparing means producing a position signal when the sensed angle becomes equal to the preset angle, and (G) control means, connected with said stop signal producing means and said comparing means so as to receive said stop signal and said position signal, and further connected with said actuating means, for changing the operating state of said weaving mechanism by commanding said actuating means to immediately stop said main mechanism from said normal speed by putting said weaving mechanism in said braking mode upon receipt of said stop signal during said normal operation mode, said control means then deactivating said braking means and starting said weaving mechanism in said first slow operating mode, and upon receipt of said position signal from said comparing means, stopping the slow speed movement of said main mechanism by putting said weaving mechanism again in said braking mode.

2. A weaving system according to claim 1, wherein said stop signal comprises a warp stop signal, a weft stop signal and a manual stop signal, and said stop signal producing means comprises a warp feeler which produces said warp stop signal when it detects an abnormal warp condition in said weaving mechanism, a weft feeler which produces said weft stop signal when it detects an abnormal weft condition in said weaving mechanism, and a stop switch which produces said manual stop signal when said stop switch is switched on.

3. A weaving system according to claim 2, wherein said preset angle comprises a first preset angle and a second preset angle, and said preset angle supplying means supplies said first preset angle to said comparing means in the presence of said warp stop signal and said second preset angle in the presence of said weft stop signal and said manual stop signal, so that said main mechanism is stopped at said first preset angle in response to said warp stop signal and at said second preset angle in response to said weft stop signal or said manual stop signal.

4. A weaving system according to claim 3, wherein said secondary driving means is capable of driving said main mechanism alternately in a forward direction and a reverse direction, and said main mechanism is driven in the forward direction in said first slow operation mode and in said normal operation mode, said weaving mechanism being capable of being in a second slow operation mode in which said secondary driving means is connected with said main mechanism and actuated to drive said main mechanism at said slow speed in the reverse direction.

5. A weaving system according to claim 4, wherein said preset angle further comprises a third preset angle, and said weaving system further comprises a forward inching switch, connected with said control means, for delivering a forward inching signal to said control means when it is switched on, and a reverse inching switch, connected with said control means, for delivering a reverse inching signal to said control means when it is switched on, said control means, upon receipt of said forward inching signal, starting the operation of said first slow operation mode, choosing said third preset angle and stopping said main mechanism when said comparing means produces said position signal at said third preset angle, said control means, upon receipt of said reverse inching signal, starting the operation of said second slow operation mode, choosing said third preset angle, and stopping said main mechanism when said comparing means produces said position signal at said third preset angle.

6. A weaving system according to claim 5, wherein said weaving mechanism further comprises a clutch which can drivingly connect said main mechanism with said secondary driving means and disconnect said main mechanism from said secondary driving means, said clutch being connected with said actuating means.

7. A weaving system according to claim 6, wherein said control means comprises a microcomputer.

8. A method for stopping a weaving machine at a desired position in response to a stop signal, comprising the steps of;

bringing the weaving machine to a complete stop by applying a brake immediately when the stop signal is generated, then, deactivating the brake and making the weaving machine run at a slow speed slower than the speed of a normal weaving operation immediately after the weaving machine is brought to a stop, sensing a crank angle of the weaving machine while the weaving machine is running at the slow speed, bringing the weaving machine running at the slow speed to a complete stop by applying the brake again when the sensed crank angle becomes equal to a predetermined crank angle.

* * * * *